United States Patent [19]

Chernock

[11] 4,065,029

[45] Dec. 27, 1977

[54] VALVE ASSEMBLY

[76] Inventor: Stephen Peter Chernock, Flax Mill Lane, Milford, Conn. 06460

[21] Appl. No.: 649,220

[22] Filed: Jan. 14, 1976

Related U.S. Application Data

[63] Continuation-in-part of Ser. No. 503,365, Sept. 5, 1974, abandoned.

[51] Int. Cl.[2] ..... B67B 7/24

[52] U.S. Cl. ..... 222/3; 251/322; 431/254

[58] Field of Search ..... 222/3, 518, 321, 322, 222/402.21, 402.22, 402.24; 251/321-323; 431/130, 131, 142, 143, 150, 276, 277, 344, 254

[56] References Cited

U.S. PATENT DOCUMENTS

| | | | |
|---|---|---|---|
| 2,177,278 | 10/1939 | Hill et al. | 251/322 |
| 2,525,617 | 10/1950 | Phillips | 222/3 |
| 2,667,993 | 2/1954 | Ayres | 251/322 |
| 3,055,201 | 9/1962 | Smith | 431/150 |
| 3,280,599 | 10/1966 | Projahn | 431/131 |
| 3,409,049 | 11/1968 | Racek | 431/344 |
| 3,490,658 | 1/1970 | Schwartzman | 222/518 |
| 3,508,689 | 4/1970 | Webster | 222/402.24 |
| 3,525,497 | 8/1970 | Zalar | 222/3 |
| 3,705,785 | 12/1972 | Goto | 431/344 |
| 3,792,963 | 2/1974 | Tricot | 431/276 |

FOREIGN PATENT DOCUMENTS

| | | | |
|---|---|---|---|
| 1,457,541 | 11/1969 | Germany | 431/254 |
| 201,633 | 2/1966 | Sweden | 222/3 |

*Primary Examiner*—Allen N. Knowles
*Assistant Examiner*—H. Grant Skaggs
*Attorney, Agent, or Firm*—Mattern, Ware, Davis and Stoltz

[57] ABSTRACT

By mounting a spring-like resiliently flexible member between the shoulder of a die cast valve stem and tabs or flanges of a valve housing so as to biasingly engage the valve stem with the valve housing in the closed position, a unique, self-contained, captured valve assembly is provided. In the preferred embodiment, the valve stem incorporates a dust deflecting shoulder in order to prevent unwanted debris from entering the area between the valve stem and valve housing. In another embodiment, the valve housing comprises two sections frictionally engaged with each other with one section manufactured from brass or aluminum to eliminate leakage therethrough. This valve assembly is particularly useful in gas lighters of the butane fuel type, since the embodiments of the present invention provide against leakage and secondary ignition.

37 Claims, 12 Drawing Figures

VALVE ASSEMBLY

RELATED APPLICATION

This application is a continuation-in-part of U.S. patent application of STEPHEN P. CHERNOCK relating to VALVE ASSEMBLIES, bearing Ser. No. 503,365, filed Sept. 5, 1974 and now abandoned.

BACKGROUND OF THE INVENTION

This invention relates to valve assemblies, and more particularly to self-contained, captured valve assemblies.

Generally, all valve assemblies comprise a valve housing, having one portal exposed to the combustible fluid, and a valve stem, mounted within the housing and either in contact with the housing or a gasket material. The valve stem is movable from a closed position, preventing flow of the combustible fluid to an open position allowing the combustible material to pass through the valve stem.

Valve assemblies can generally be classified as either "captured" and "self-contained" or "uncaptured". The captured valve assemblies comprise a closed unit with the valve stem, valve housing, gasket material, if used, and biasing member enclosed therein by a bushing member so as to form a single unitary product. The uncaptured valve assemblies eliminate the bushing member and have each component separate, requiring a final assembly and an external member to bias the valve stem in the closed position.

The major difference between captured valve assemblies and uncaptured valve assemblies is the cost of manufacturing. In the captured, or self-contained, valve assembly, the biasing member, which is generally a spring, is mounted directly within the valve assembly under compression between the valve stem and the bushing member, in a manner which biases the valve stem into the closed position with the valve housing. In order to produce a valve stem which will accommodate the captured spring and allow the valve stem to be biasingly engaged with the valve housing, and slidably through the bushing member without leakage, the valve stem must be separately machined. As a result, the valve stem is an expensive item to manufacture. Consequently, the captured or self-contained valve assembly, although preferable in most applications since assembly is complete, is a more expensive valve assembly, due to the labor involved and the cost of manufacturing.

In the uncaptured valve assembly, the valve stem may be die-cast, since its construction is relatively simple compared to the captured valve stem. As a result, the uncaptured valve assembly is much less expensive than the captured valve assembly, but requires additional labor in its final assembly, as well as additional parts handling problems. Also, the uncaptured valve assembly requires an external biasing member to move the valve stem from a closed position to an open position and also to bias the valve stem in the closed position when combustible fluid flow is not desired.

Another problem found with prior art valve assemblies is the inherent cost necessitated by the requirement of machined housings. Since the base of the housing is in direct contact with the combustible fluid, a machined housing is needed to prevent leakage. If a die cast housing were employed, the porosity of the die cast housing would allow leakage of the combustible fluid through its walls to the atmosphere. This would cause a loss of fluid, as well as secondary ignition.

An additional problem found in uncaptured valve assemblies is leakage of the combustible fluid between the valve stem and the valve housing, which results in loss of fluid and can produce secondary ignition when the valve stem is in the open position. Secondary ignition is extremely undesirable since it can cause deterioration of the external member controlling the valve stem.

It is a principal object of this invention to provide a captured or self-contained valve assembly that is easy and inexpensive to manufacture and competitive with the cost of uncaptured valve assemblies.

Another object of this invention is to provide a captured or self-contained valve assembly of the above character which eliminates secondary ignition.

Another object of this invention is to provide a captured or self-contained valve assembly of the above character employing a die-cast or molded valve stem.

A further object of this invention is to provide a captured or self-contained valve assembly of the above character wherein O-ring seals are eliminated and the potential leaking zone are efficiently and completely sealed with an inexpensive flexible sealing system.

Other and more specific objects will in part be obvious and will in part appear hereinafter.

A further problem found in prior art value assemblies is the need for O-rings. O-rings are generally employed for sealing the area between the valve housing and the case in which the housing is mounted. The O-rings, however, suffer from two troublesome problems—cost and flash. O-rings have become expensive items and increase the cost of the valve assembly. Also, since O-rings are molded products, they incorporate flash about their periphery which produces gaps in the sealing area and allows leakage of the combustible fluid.

SUMMARY OF THE INVENTION

In the valve assembly of this invention, a die-cast or molded valve stem, similar to the type of valve stem employed in non-captured valve assemblies, is used in combination with a valve housing. However, a captured valve assembly is created by mounting a resilient flexible member between a shoulder of the valve stem and tabs or flanges of the valve housing so as to biasingly engage the valve stem with the valve housing, while also completely eliminating the need for a bushing member. In this way, a completely captured or self-contained valve assembly is created having all of the advantages of a captured valve assembly while having the cost and component production advantages of an uncaptured valve assembly.

In one embodiment, the valve stem also incorporates an additional dirt deflecting shoulder which peripherally surrounds the valve stem near the opening of valve housing and prevents dirt and similar particulate matter from entering the valve housing adversely affecting the sliding engagement of the valve stem in the valve housing. Also, the shoulder of the valve stem which engages the flexible member provides a baffle for capturing any leaking fluid, thereby substantially eliminating secondary ignition.

The valve assembly of this invention is a completely closed or self-contained valve assembly ready for installation in a desired unit. Furthermore, the embodiment, which incorporates the peripherally surrounding shoulders, prevents any escape of the combustible fluid between the walls of the valve stem and the valve housing, thereby eliminating leakage and secondary ignition, while also preventing entry of particles into the valve assembly, thereby assuring trouble-free operation.

In another embodiment, the valve housing comprises two separately manufactured sections which are frictionally engaged during assembly. One section is machined, while the other section is die cast, thereby reducing the overall cost of the housing. The valve housing section which is machined comprises the entire housing area which is exposed to the combustible fluid. In this way, leakage is prevented while also reducing the cost.

The two-section housing also incorporates internal dust and particle collecting zones which are spaced away from the walls along which the valve stem is slidingly engaged. In this way, particulate debris and dust, is collected and held in this zone, thereby assuring the free, slidability of the valve stem without fear of "hanging-up" due to particle contamination.

A further feature of the present invention is the sealing system that may be employed in place of O-rings. The sealing system of the present invention incorporates flexible tubing in combination with position-retaining ridges or rings. In the preferred embodiment, the flexible tubing comprises flatened, solid rubber which is stretched about one or two position-retaining rings formed on the valve housing. When mounted in place, the tubing conforms to the area into which it is forced, and completely seals the area from leakage. Furthermore, the tubing is substantially less expensive than O-rings, and does not incorporate flash which is capable of establishing leak paths.

The invention accordingly comprises an article of manufacture, possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
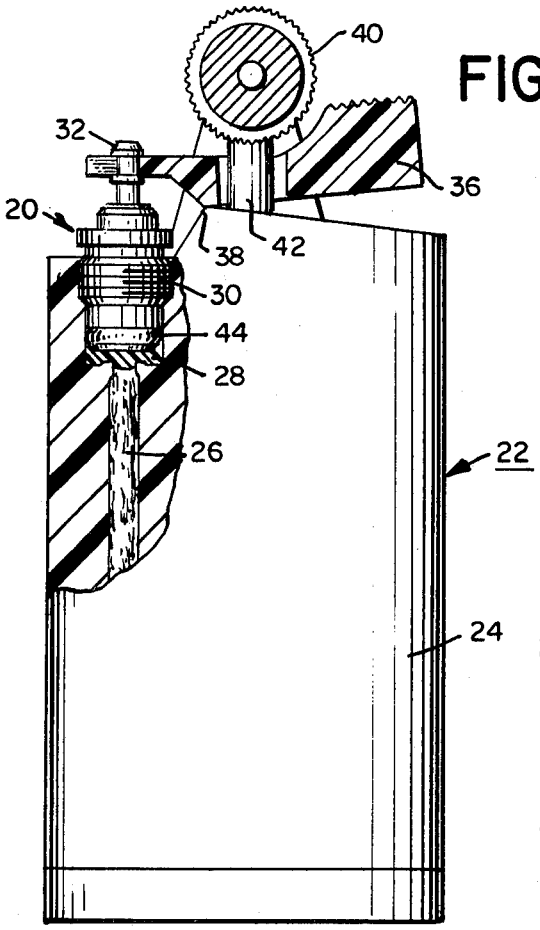
FIG. 1 is a side elevation view partially in cross-section of a typical gas ligher employing the valve assembly of this invention.

In FIG. 1, valve assembly 20 is shown mounted in a typical gas ligher 22. The description and operation of valve assembly 20 will be made in reference to gas ligher 22 for exemplary purposes only. As will be obvious to one skilled in the art, valve assembly 20 of this invention can be used in other suitable operations employing combustible fluid with the use of the valve assembly of this invention in gas lighter 22 being merely exemplary of that use.

Figure 2:
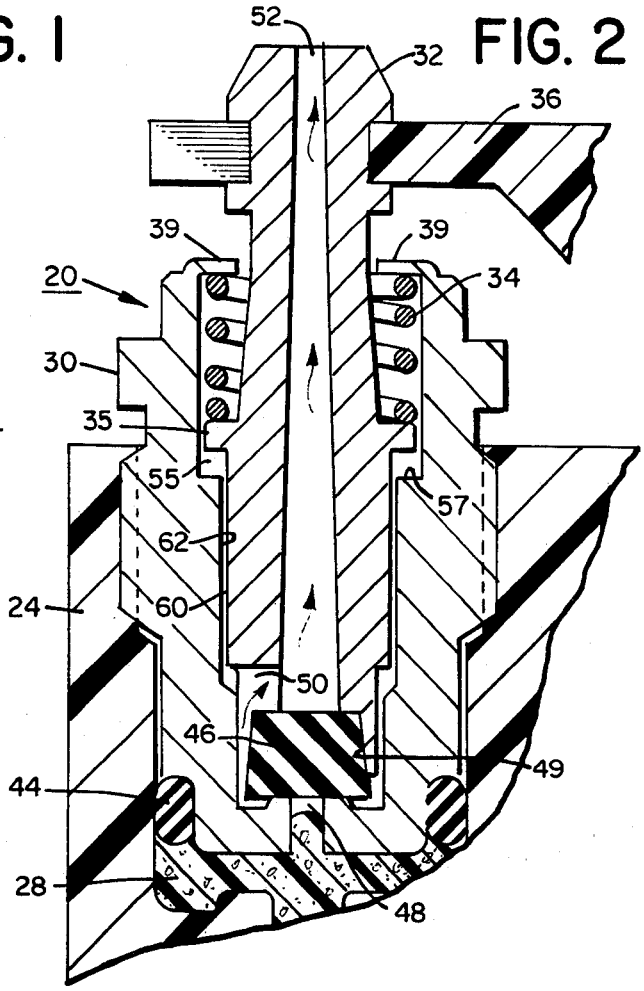
FIG. 2 is a cross-sectional side elevation view of one embodiment of the valve assembly of this invention, taken along line 2—2 of FIG. 1.

As shown in FIGS. 1 and 2, gas ligher 22 comprises a case 24 in which combustible fluid is contained. Presently, liquified butane is employed in many of the gas lighters. The combustible fluid is brought to a metering pad 28 by means of wick 26. Both wick 26 and metering pad 28 are particularly useful with butane fuel.

Valve assembly 20 is threadedly engaged with housing 24 of ligher 22, and comprises a housing 30 and a valve stem 32. As is more fully described below, valve stem 32 is biasingly engaged in housing 30 in a closed position by means of resiliently flexible biasing member 34 shown in FIG. 2. This is achieved by securing flexible member 34 under compression between shoulder 35 of valve stem 32 and tabs 39 of housing 30.

Since valve stem 32 is held in the closed position by flexible member 34, lever 36 is employed to move valve stem 32 vertically upward into the open position. Lever 36 incorporates a pivot point 38 and when lever 36 is moved downwardly, lever 36 pivots about pivot point 38, causing valve stem 32 to move upwardly into the open position, placing flexible member 34 under additional compression. When spark wheel 40 is rotated causing a spark to be produced by the friction between spark wheel 40 and flint 42, the gas escaping through valve stem 32 is ignited. Then, when the flame is to be extinguished, the downward force on lever 36 is removed and the resilient forces of flexible member 34 causes valve stem 32 to return to the closed position.

By referring to FIG. 2, the construction and operation of one embodiment of valve assembly 20 of this invention can best be understood. Housing 30 of valve assembly 20 is threadedly engaged with case 24 of ligher 22, and is sealed therein by means of O-ring seal 44, or, preferably, by the sealing system of this invention, which is described in detail below. In the normal position, flexible member 34 is under sufficient compression to biasingly engage valve stem 32 with valve housing 30 maintaining valve stem 32 in the closed position by exerting sufficient force on valve stem 32 to maintain it in contact with a gasket or stopper plug 46 and portal 48. As a result, the combustible fluid which passes through wick 26 and metering pad 28 into the portal 48 of housing 30 cannot enter into valve stem 32 when valve stem 32 is in the closed position. When lever 36 is moved, as discussed above, causing valve stem 32 to move upwardly, the combustible fluid enters portal 50 of valve stem 32 and passes through the center hole 52 of valve stem 32.

In the embodiment shown in FIG. 2, flexible member 34 comprising a coil spring which peripherally surrounds valve stem 32, securely mounted in this position under compression with one end thereof in contact with shoulder 35 of valve stem 32 and the other end in contact with tabs 39 of housing 30. Flexible coil spring member 34 is manufactured with sufficient convolutions and wire diameter, as is well-known in the art, in order to assure the desired amount of biasing pressure on valve stem 32 against gasket or plug 46, sealing off portal 48. Furthermore, the number of convolutions in the coil spring embodiment of flexible member 34 or the distance between these convolutions is maintained at a level that will assure that valve stem 32 can be raised by lever 36 a sufficient distance to allow the combustible fluid to pass through portal 50 and 52 of valve stem 32.

In the embodiment shown in FIG. 2, valve stem 32 incorporates a stopper receiver zone 49 in its bottom end which allows stopper plug 46 to be securely retained therein. This encased stopper plug 46 has been found to be much more effective than conventional loose plugs or gaskets. By employing this construction, prior art difficulties of the gasket or plug becoming dislodged is completely eliminated. Consequently, the resulting valve "hang up" and leakage due to insufficient shut-off pressure is prevented.

Figure 4:
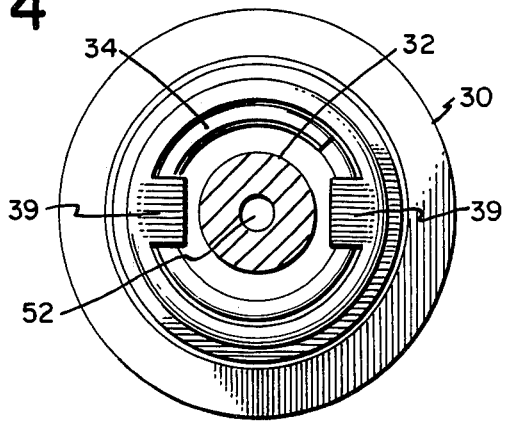
FIG. 4 is a top plan view, partially in cross-section, of one embodiment of the valve assembly of this invention taken along line 4—4 of FIG. 2.

Another feature of valve stem 32 is its tapered shape about the area where flexible member 34 is mounted. Although this taper is optional, it is preferred in order to provide a quick and easy assembly procedure. By having this outer peripheral surface tapered, flexible member 34 can easily be inserted over the top of valve stem 32 and quickly dropped in place in contact with shoulder 35. The assembly procedure is quickly contemplated by compressing flexible member 34 and securing flexible member 34 in place by bending over holding tabs 39, as shown in FIG. 4.

The number and location of tabs 39 on the peripheral top surface of housing 30 is completely optional. The only requirement is that a sufficient number are included in order to assure the complete secure retention of flexible member 34. Generally, two to four tabs are employed, but if desired, a peripherally surrounding ring can be employed.

By employing the valve assembly of this invention, a completely captured or self-contained valve assembly is achieved with a minimum of parts. Even more important, the captured or self-contained valve assembly of this invention employs a valve stem which is manufactured by die casting, molding or other similar process heretofore only employable for the manufacture of valve stems of the non-captured valve assembly types.

As discussed above, in prior art captured valve assemblies, the coil springs are secured between a shoulder of the valve stem and a retaining bushing which is threadily engaged with the housing of the valve assembly. Since the valve stem has to slide through the retaining bushing, the valve stem has to be machined to a close tolerance which will slidingly engage the retaining bushing while also assuring no passage of fluid therethrough. As a result, the valve stems of these prior art captured valve assemblies are extremely more expensive to manufacture than the valve stem employable in the valve assembly of this invention.

As previously discussed, one of the major problems found with prior art non-captured valve assemblies is the assembly difficulties encountered in order to assure a workable unit. An additional problem continuously experienced with prior art non-captured valve assemblies is the leakage of the combustible fluid and secondary ignition of this leaking fluid. Using the valve assembly shown in FIG. 2 for exemplary purposes of this difficulty, when valve stem 32 has been raised in order to allow the flow of the combustible fluid through the valve stem, leakage may occur between outer wall 60 of valve stem 32 and inner wall 62 of valve housing 30. The only deterrent employed in the prior art in order to prevent this type of gas leakage is the tolerances which are employed for these interfitting parts. However, even though close tolerances are attempted to be maintained, leakage does occur and the leaking gases can be ignited by the spark, causing undesirable deterioration of the surrounding parts by this secondary ignition.

In prior art captured valve assemblies, a further problem exists with leaking combustible fluid. When the valve is raised to the fluid flow position, gas builds up around the area in which the spring is held, between the outer wall of the valve stem and the inner wall of the housing. Since these prior art valve assemblies incorporate spring retaining bushings which prevent the escape of the fluid, the fluid builds up in this pocket and cannot escape as long as the tolerances between the valve stem and the retaining bushing are precise enough to prevent leakage. If these tolerances are not precise, then secondary ignition will result with the same detrimental effects being produced as discussed above.

If these tolerances are properly maintained, the gas will build-up and escape when the valve assembly has returned to the closed position. In this situation, the flame continues to burn though the valve assembly is in the closed position.

This continued burning phenomenon is a critical problem which poses a hazard to anyone using this type of valve assembly. When the valve assembly is closed, the flame should extinguish immediately in order to provide the user with complete safety.

By employing the captured valve assembly 20 of this invention, secondary ignition is substantially eliminated, and any continued flame after shut-off is prevented. This is achieved by (1) maintaining close tolerances between walls 60 and 62 in order to substantially eliminate any fluid leakage (2) using shoulder 35 as a baffle against the free flow of any combustible fluid that does manage to escape between wall 60 of valve stem 32 and wall 62 of housing 30, and establishing an annular fluid retaining zone 55 between shoulder 35 of valve stem 32 and ledge 57 of housing 30 to capture any leaking fluid. In this way, any fluid which manages to escape between the close tolerances of walls 60 and 62 comes in contact with shoulder baffle 35 and is retained in annular zone 55.

As a result, any rush of combustible fluid through the valve housing to the area where it can be ignited is prevented and secondary ignition is substantially eliminated. Also, no fluid is able to build up in any area that could cause a flame to remain burning when the valve assembly has been shut off. Therefore, the valve assembly of this invention incorporates all of the cost advantages of the non-captured valve assembly while also having all of the positive characteristics of the captured assemblies.

Figure 3:
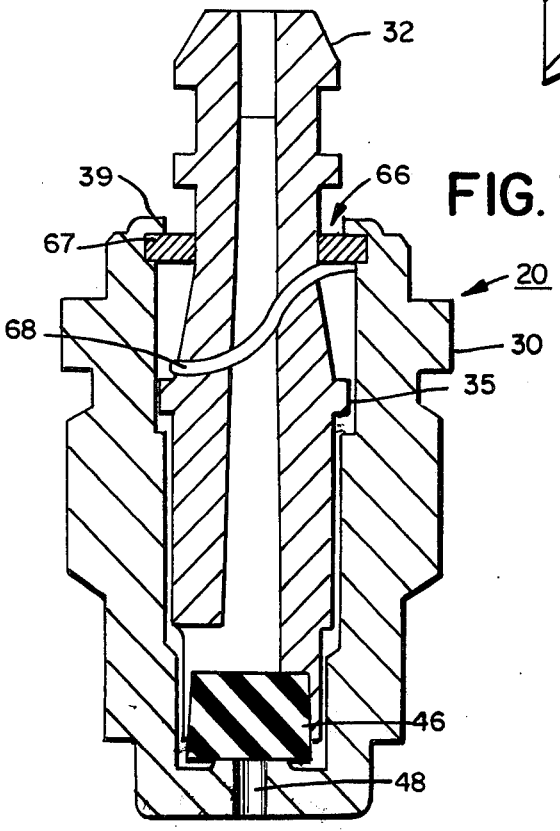
FIG. 3 is a cross-sectional side elevation view of a second embodiment of the valve assembly of this invention.

In FIG. 3, another embodiment of the valve assembly 20 of this invention is shown. This additional embodiment is shown merely for illustrative purposes in order to represent the various configurations that can be employed for the biasing member 34 which maintains the valve stem in a closed position within the valve housing, while also assuring sufficient force and resiliency to allow raising of the valve stem into an open position and then returning the valve stem to the closed position when the raising force is eliminated.

In this embodiment the valve housing and the valve stem are substantially identical to the construction described in FIG. 2, with the only variation being the flexible member employed. In this embodiment, flexible member 66 comprises an annular disc manufactured of spring steel, or similar resilient material, which incorporates arcuately extending arms 68 extending below the main body 67 of the disc. Flexible member 66 is mounted peripherally surrounding valve stem 32 with arm 68 extending from the disc body 67 and resting on shoulder 35 of valve stem 32. Body 67 of disc 66 is held in compression by means of tabs 39. In this way, when valve stem 32 is raised, arm 68 are formed more closely to body 67 of disc 66 causing the compressive force to be increased. When the raising force is removed, the compressive forces of disc spring 66 forces valve stem 32 to return to the closed sealed position with stopper plug 46 sealed against portal 48.

The use of resilient spring 66 provides the advantage of quick and easy installation while assuring a positive compressive force for maintaining a closed, captured valve assembly. Furthermore, this embodiment of the valve assembly of this invention provides all of the advantages discussed above in relationship to the embodiment shown in FIG. 2.

Figure 5:
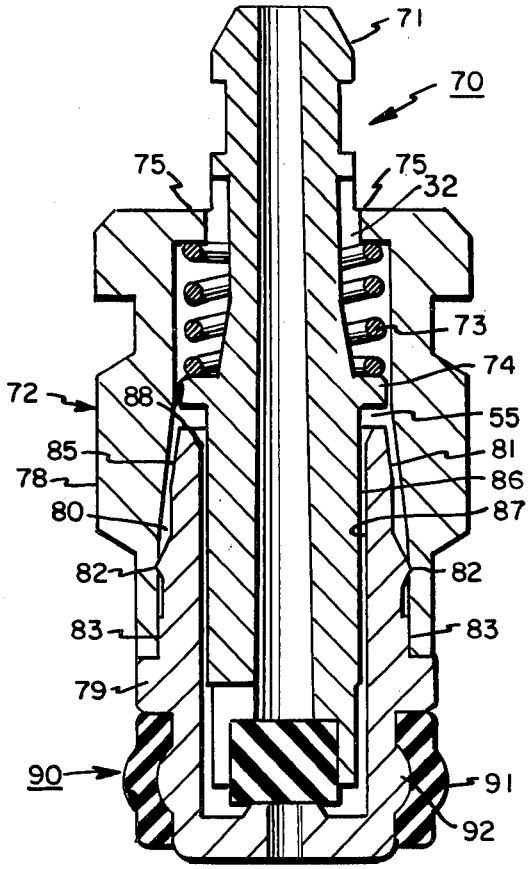
FIGS. 5 and 6 are cross-sectional side elevation views of additional embodiments of the valve assembly of the present invention incorporating a two-piece valve housing.
Figure 6:
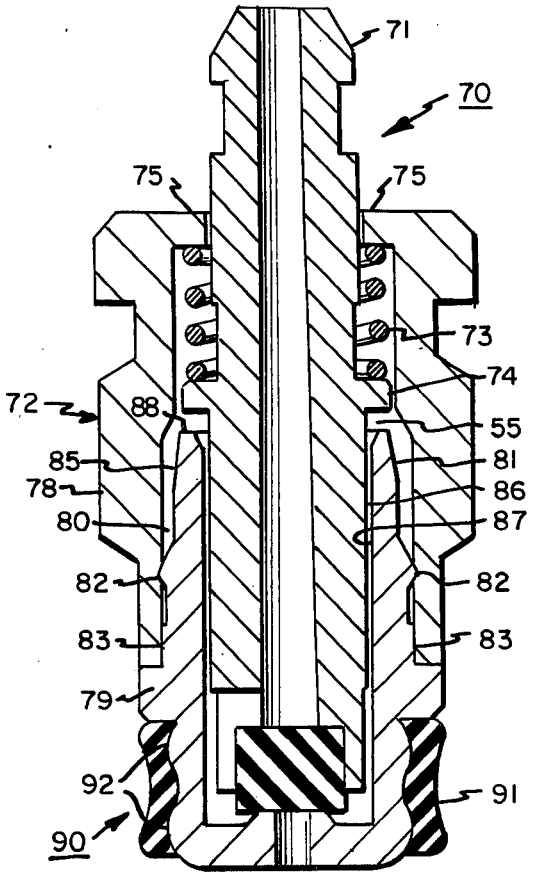

In FIGS. 5 and 6, additional embodiments of the valve assembly of the present invention are shown. In this embodiment, valve assembly 70, comprises a valve stem 71 and a two-piece valve housing 72. Valve assembly 70 also incorporates a flexible member 73 which is biasingly engaged between radially extending shoulder 74 of valve stem 72 and peripherally surrounding ring 75 of housing 72. If desired, a foldable tab as described above may be employed on housing 72, but since the assembly operation of valve assembly 70 is most efficiently achieved through the base of housing 72, as will be fully described below, an integrally formed retaining ring 75 is preferred. However, as will be obvious to one skilled in the art, either arrangement may be employed depending upon the particular preference of the user. Furthermore, valve stem 70 comprises a substantially right cylindrical shape along its entire length, however, if a tapered valve stem is desired, as discussed above, the tapered valve stem may also be employed.

In this embodiment, valve housing 72 comprises two separate pieces, an upper section 78 and a lower section 79. Upper section 78 incorporates an inner surface 80 which is frictionally engaged with an outer surface 81 of lower section 79. This frictional engagement is preferably achieved at two separate peripherally surrounding locations indicated generally at 82 and 83. As will be obvious to one skilled in the art, this "press fit", frictional engagement may be achieved at one or more than two locations. However, it has been found that complete sealing and leak prevention, along with relative inexpensive manufacturing costs, is best achieved with two individual frictionally engaged areas.

By employing two-piece valve housing 72, upper section 78 is capable of being manufactured by die-casting, thereby substantially reducing the cost of machining the entire valve housing, as required in prior art units. Lower section 79 is manufactured by machining and is preferably constructed from brass or aluminum. The machined lower section 79 completely covers all of the areas of valve housing 72 which will be directly exposed to the combustible fluid. In this way, the inherent porosity found in die-cast parts will not produce any leakage, since the only die-case part of valve housing 72 is the upper section 78, which does not come in direct contact with the combustible fluid. As a result, an inexpensive valve housing 72, which is easily and readily assembled while still assuring complete prevention of any leakage of the combustible fluid to the valve housing.

Another feature provided by valve housing 72 is the establishment of a dust, dirt and particle collection zone 85. Collection 85 is established between inner wall 80 of upper section 78 and outer wall 81 of lower section 79, between the extension of these walls above frictional sealing zone 82. As discussed above, one of the problems inherent with prior art valve systems is the difficulty encountered with the valve stem binding or "handing up" due to particulate matter, dust, and dirt entering the valve assembly and working its way between the sliding walls of the valve stem and the valve housing. With valve assembly 70 of the present invention, this difficulty is completely eliminated.

The construction of valve assembly 70 prevents binding or "hanging up" of outer wall 86 of valve stem 71 in its sliding contact with inner wall 87 of valve housing 72, due to the incorporation of collection zone 85 and the cooperation of collection zone 85 with the unique construction and arrangement of valve assembly 70. One feature of valve assembly 70, which provides against particulate matter causing the valve stem 71 to bind, is the position and construction of radially extending shoulder 74 of valve stem 71.

If any particulate matter were to filter in between valve stems 71 and ring 75 of housing 72, the particulate matter will be able to work its way down to radially extending shoulder 74 of valve stem 71. When it reaches this position, any further downward movement of the particulate matter will be deflected by shoulder 74 away from the body of valve stem 71 and into annular collection zone 75. In this way, entry of this particulate matter into the critical sliding zone between outer wall 86 of valve stem 71 and inner wall 87 of lower section 79 is prevented, and binding or hanging up is eliminated.

Further protection against particulate matter entering this critical zone is provided by a small amount of gas which passes through the closely held toleranced zone between walls 86 and 87 when the valve is in the open position. If any particulate matter is able to enter this critical, limited-size zone between walls 86 and 87, the gas leaking up through this area will force the particulate matter upwardly into radially extending shoulder 74. Upon hitting shoulder 74, the particulate matter will be deflected and will fall into collection zone 85.

A similar gas-collecting zone 55, as was described above, is formed between shoulder 74 and the upper end or ledge 88 of lower portion 79 in which any leaking gas is collected and harmelessly disperses from this area to the atmosphere. As a result, trouble-free operation of valve stem 71 in housing 72 is assured, while secondary ignition caused by harmful quantities of leaking gas is also prevented.

The assembly operation for constructing captured valve assembly 70 of the present invention is best achieved from the bottom of valve housing 72. In this assembly operation, flexible member 73, which is generally a coil spring as described above, but may also be other flexible spring means, is positioned in contact with retaining ring 75 of upper section 78. As described above, retaining ring 75 is preferably an integrally formed portion of upper section 78, constructed in a single die cast operation. However, if desired, foldable tabs or a foldable ring could be employed.

Once flexible member 73 is in position, valve stem 71 is inserted through flexible member 73 with its fluid outlet end extending from upper section 78 of housing 72 and its radially extending shelf 74 in contact with the other end of flexible member 73. The assembly operation in then completed by inserting lower section 79 into frictional engagement with upper section 78. In this way, valve assembly is completed, and a captured valve assembly is inexpensively provided which is capable of error-free operation, solving all of the prior art difficulties heretofore unobtainable with an inexpensively constructed captured valve assembly.

An additional feature of the valve assembly of the present invention is the sealing system 90 shown in FIGS. 5 and 6. Sealing system 90 comprises a flexible sealing member 91 in cooperation with at least one position retaining ridge or ring 92 formed about the lower end of housing 72. In the preferred embodiment, flexible sealing member 91 comprises a flattened rubber-like member of uniform crosssectional area, such as tubing. Flexible sealing member 91 is frictionally engaged and secured about the entire periphery of retaining ring 92, extending therefrom the particular thickness provided by sealing member 91. When valve assembly 70 is inserted into a housing 24, as shown in FIG. 1, flexible member 91 completely wipes the housing portal area free of all accumulated dirt and dust, and conforms to the particular sealing area provided. Since flexible member 91 is completely retained in its securely mounted position about lower section 79 of valve housing 72, flexible member 91 is capable of completely and securely sealing the entire area from escaping gas.

In the preferred embodiment, flexible member 91 comprises inexpensive rubber tubing which is readily available and manufactured without undesirable flash, since the preferred tubing is manufactured by extrusion. If however an elongated flexible member were employed which did incorporate flash, the flashing would exist along the top and bottom edges of flexible member 91, and would not in any way interfere with the primary sealing area.

In FIG. 6, an alternative embodiment for sealing system 90 of the present invention is shown, wherein two position retaining ridges or rings 92 are employed to secure flexible member 91 in its position about lower section 79 of housing 72. As shown in FIG. 6, the employment of two or more retaining rings provide alternative surface characteristics to flexible member 91, thereby allowing the user to employ the most convenient type of arrangement depending upon the particular configuration of the sealing zone. Regardless of whether one large retaining ring, one small retaining ring, or a combination of different or similar sized retaining rings are employed, the cooperation of flexible member 91 with retaining ring 92 provides a sealing system capable of superior performance over prior art O-rings without the high cost and leakage problems which exist with the use of prior art O-rings.

Figure 7:
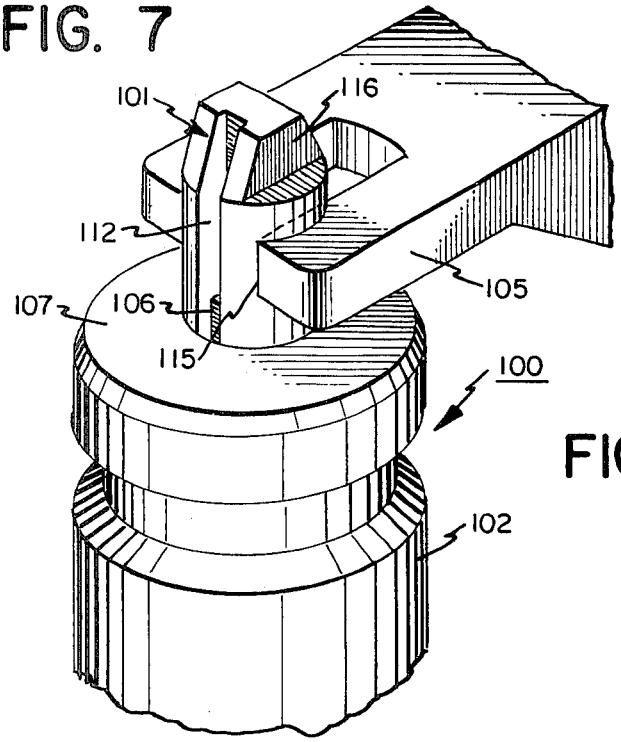
FIG. 7 is a perspective view of a further embodiment of the valve assembly of this invention.
Figure 8:
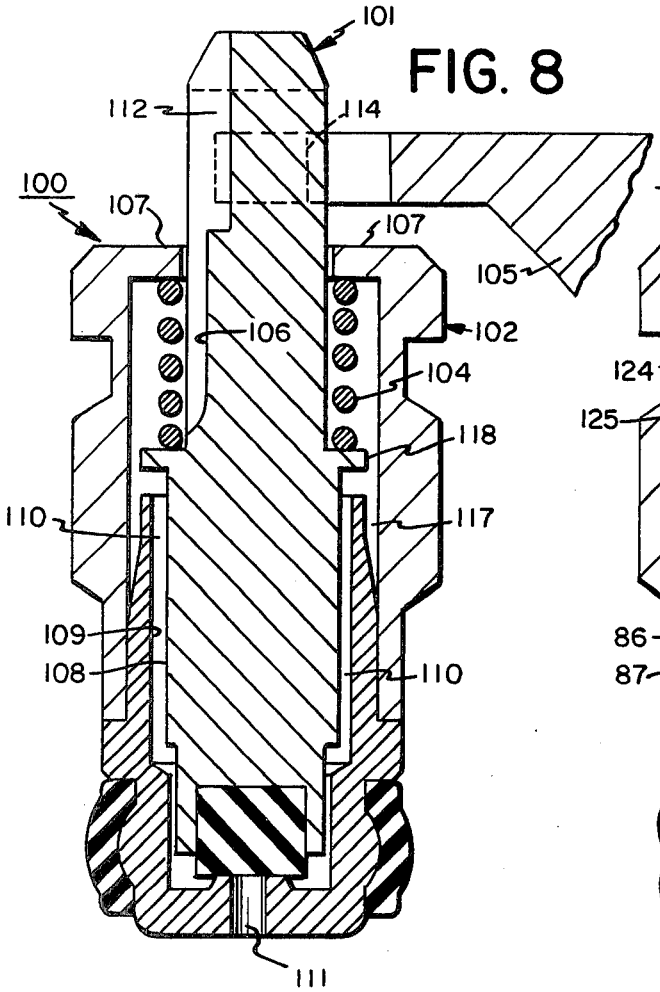
FIG. 8 is a cross-sectional side elevation view of the valve assembly of FIG. 7.

In FIGS. 7 and 8, another embodiment of the valve assembly of the present invention is shown. In this embodiment, valve assembly 100 comprises a valve stem 101 and a valve housing 102 within which valve stem 101 is slidingly engaged and mounted therein as a captured valve assembly maintained in the closed position by biasing spring 104 and moved vertically upward to the open position by arm 105. The general construction and operation of valve assembly 100 is similar to the embodiments defined above, except for the unique features detailed below, and can be employed with any combination of the features defined in the foregoing embodiments, as well as with prior art arrangements.

In this embodiment however, valve stem 101 eliminates the necessity of a central gas flow passageway extending entirely through the valve stem as shown in the previous embodiments and as thoroughly defined in this specification in reference to FIG. 2. Instead, valve stem 101 comprises a solid member easily and inexpensively formed from solid stock material or by die casting. By eliminating the boring or drilling step required to form the central gas flow passageway in the valve stem, an extremely inexpensive valve stem is achieved.

In order to achieve the desired gas flow when valve stem 101 has been raised from the closed position to the open position by arm 105, valve stem 101 incorporates a combustible fluid flow channel 106 which provides sufficient clearance between channel 106 and retaining ring 107 of housing 102. Also, channel 106 extends below ring 107 a sufficient distance to establish the desired free, unobstructed flow path, thereby assuring continuous fluid flow.

As shown in FIG. 8, valve stem 101 comprises a solid member throughout its entire length with a substantially cylindrical wall 108 which is slidingly engaged with cylindrical wall 109 of valve housing 102, forming a gas flow zone 110 therebetween. In this embodiment, the distance between walls 108 and 109 are controlled to allow sufficient gas flow in the annular gas flow zone 110. As shown by the gas flow lines of FIG. 8, when valve stem 101 is in the open position the combustible fluid flows through portal 111 into annular zone 110 up to peripherally surrounding ring 107 of valve housing 102. Since the combustible fluid takes the path of least resistance as its flow path, the fluid flows between ring 107 of valve housing 102 and channel 106 of valve stem 101. In this way, the fluid exits from valve housing 102 along channel 106 of valve stem 101 and continues along a flow path substantially parallel to channel 106 until it rises above valve stem 101 and is ignited by the spark. The ignited flame will be continually refueled by additional rising fuel which follows substantially the same flow path. The flame is extinguished when the pressure on control arm 105 is removed and valve stem 101 is returned to the closed position due to the flexible biasing member 104.

In the preferred embodiment, channel 106 incorporates an enlarged channel zone 112, extending from channel 106 above ring 107. Enlarged channel zone 112 establishes an enlarged fluid feeding area to the ignited flame, thereby providing a stabilized flame, not prone to flickering. Furthermore, zone 112 stabilizes the fluid flow, and prevents separation of the combustible fluid from channel 106 prior to reaching the flame.

Figure 9:
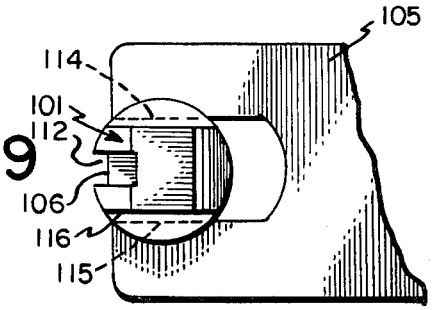
FIG. 9 is a top plan view of the valve assembly of FIG. 7.

One important requirement for assuring the proper functioning of valve assembly 100 for controlling the flow of the combustible fluid and providing a usable flame, is the requirement for maintaining the position of channel 106 in the desired location for proper ignition of the escaping fluid. This position is maintained by employing positionretaining slots 114 and 115 along the sides of valve stem 101 and employing these slots for control arm 105 (best seen in FIG. 9). During the assembly operation, housing 102 is threaded into its engaged position in the body of the gas lighter. Valve stem 101 is then rotated until channel 106 is in the desired position, and then control arm 105 is slipped into position-retaining slots 114 and 115, thereby maintaining the precise location and position of valve stem 101 and its flow channel 106.

If desired, a position indicator 116 (FIG. 7) well-known in the art can be employed to assure that valve stem 101 is placed in the proper orientation. Furthermore, indicator 116 can be employed in automatic assembly operations to provide error-free assembly of valve assembly 100 with a minimum of expense.

By employing valve stem 101 with two-piece valve housing 102, an annular debris collection zone 117 is provided and is extremely useful. Since the combustible fluid flows through zone 110, any debris that enters zone 110 is forced upward with the flowing fluid. The debris hits radially extending shelf 118 of valve stem 101 and is deflected therefrom into collection zone 117. In this way, debris cannot build up in zone 110 and interfere with the operation of valve assembly 100.

Figure 10:
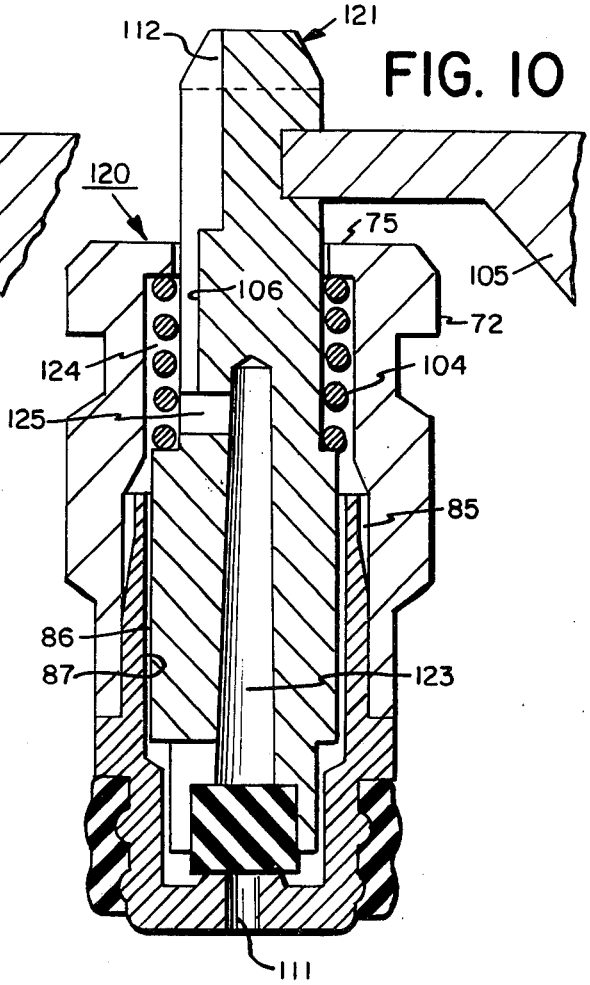
FIG. 10 is a cross-sectional side elevation view of a still further embodiment of the valve assembly of this invention.

In FIG. 10, another embodiment of the valve assembly of this invention is shown. In this embodiment, valve assembly 120 incorporates a valve stem 121 having a combustible fluid flow channel 106 and a centrally located fluid flow passageway 123 extending from the bottom of valve stem 121 part way through its length. Passageway 123 communicates with annular zone 124 in which flexible biasing member 104 is positioned. In this way, another inexpensive valve stem is achieved by reducing the expensive drilling or boring of the central passageway entirely through the valve stem while providing a valve stem which is dimensionally compatible with valve housing 72, as well as the valve housing of the other embodiments described above.

When valve stem 121 is moved to the open position by arm 105, the combustible fluid flows through portal 111 at the base of valve housing 72, and into central passageway 123 of valve stem 121. Since passageway 123 extends only part way through valve stem 121, the combustible fluid exits from passageway 123 through portal 125 into annular zone 124, which is established between the outer wall of the valve stem 121 and the inner wall of valve housing 72. The combustible fluid then exits through fluid flow channel 106 of valve stem 121 between channel 106 and retaining ring 75 of valve housing 72. The combustible fluid flows along channel 106 and enlarged channel 112, of valve stem 121 to be ignited by the spark and to continuously fuel the flame until the pressure is removed from arm 105 and valve stem 121 is biasingly returned to the closed position.

Although the overall flow of the combustible fluid will be directly through portal 125 and along channel 106 and channel 112, some combustible fluid may build up within annular zone 124. However, since the path of least resistance is between channel 106 and retaining ring 75 of valve housing 72 and the tolerances between the outer wall of valve stem 121 and retaining ring 75 is closely maintained, no leakage occurs and the entire combustible fluid flows along channel 106 and enlarged channel 112 to the ignited flame. In this way, secondary ignition is prevented and trouble-free operation of valve assembly 120 is achieved.

By employing valve stem 121, secondary ignition is substantially completely eliminated. Since the main combustible fluid flow is through central passageway 123, portal 125 and along channel 106 and enlarged channel 112, only a small amount of combustible fluid will leak through the annular zone between cylindrical wall 86 of valve stem 121 and cylindrical inner wall 87 of valve housing 72. As discussed above, the slight leakage between walls 86 and 87 will force any debris out of this zone and into debris collection zone 85. Furthermore, the leaking combustible fluid will then enter annular zone 124 and merely exit along channel 106 and enlarged channel 112 with the main flow path of the combustible fluid.

In this way, no combustible fluid builds up in areas where fluid buildup can produce secondary ignition and deterioration of the valve assembly. As a result, no secondary ignition will occur and when valve stem 121 is returned to the closed position, as shown in FIG. 10, the flow of the combustible fluid will cease. Valve stem 101 is similarly constructed and operates in the same overall manner to also eliminate secondary ignition.

Figure 11:
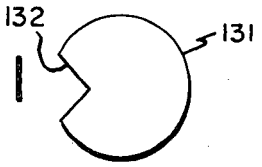
FIGS. 11 and 12 are top plan views showing various configurations for valve stems.
Figure 12:
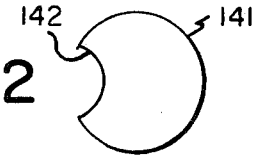

As would be apparent to one skilled in the art from a reading of this disclosure, the flow channel along which the combustible fluid flows can be of any desired size and shape. For exemplary purposes only, FIG. 11 shows a valve stem 131 wherein a V-shaped flow channel is provided. In FIG. 12, valve stem 141 incorporates a curved flow channel 142. These various configurations are shown merely as exemplary constructions which indicate the broad scope in which a variety of configurations can be employed without departing from the teaching and scope of this invention.

As will be obvious to one skilled in the art many variations of construction to the valve assembly of this invention are possible. Basic embodiments and construction alternatives have been disclosed for exemplary purposes in order to show some of these possible variations. However, an inexpensive captured valve assembly is clearly obtainable in a variety of alternative ways by employing the teaching of this invention without departing from the scope of this disclosure.

It will thus be seen that the objects set forth above, among those made apparent from the preceding description, are efficiently attained and, since certain changes may be made in the above article without departing from the scope of the invention, is intended that all matter contained in the above description and shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A valve assembly for controlling the flow of a combustible fluid comprising:

A. a housing incorporating a. a combustible fluid portal at one end thereof positioned for receiving and passing said combustible fluid therethrough, b. retaining means formed on the opposite end thereof for securely holding a flexible member in position c. an inner wall portion which is slidingly engaged with a valve stem, and a concave debris collecting zone 1. formed in the housing and 2. having an entrance located between the retaining means and the slidingly engaged portion of the inner wall of the housing, providing a particulate debris collecting and storing zone;

B. a valve stem
  a. slidably mounted within said housing and extending therefrom,
  b. movable from a first closed position to a second open, fluid flow position,
  c. having an outer wall, a portion of which is in sliding engagement with said inner wall portion of the housing, forming a sliding zone therebetween, and
  d. incorporating a shoulder radially extending from the outer wall thereof towards the peripherally encircling housing and spaced above the entrance of the collection zone, thereby providing a deflector for directing particulate debris into the collection zone and away from the sliding zone, preventing debris fouling of the sliding zone; and, C. a flexible member
  a. mounted under compression between said shoulder portion of said valve stem and said retaining means of said housing in direct contact with said retaining means, and
  b. normally biasing said valve with said housing in said first closed position.

2. The valve assembly defined in claim 1, wherein said flexible member comprises a coil spring.

3. The valve assembly defined in claim 1, wherein said valve assembly is manufactured by die casting.

4. The valve assembly defined in claim 1, wherein the outer peripheral surface of said valve stem above said radially extending shoulder portions is tapered.

5. The valve assembly defined in claim 1, wherein said housing comprises a ledge portion positioned for cooperation with said radially extending shoulder of said valve stem for defining therewith an annular zone for trapping and retaining leaking fluid in said zone and harmlessly dispersing said trapped fluid therefrom.

6. The valve assembly defined in claim 5, wherein the outer wall of said valve stem below said shoulder and the inner wall portion of said housing comprise dimensions providing a free sliding engagement and substantial fluid leakage prevention therebetween, thereby eliminating secondary ignition.

7. The valve assembly defined in claim 1, wherein said valve stem is further defined as comprising a sealing plug-receiving zone in one end thereof for securely retaining a sealing plug therein, assuring precise and repeated sealing against said fluid portal of said housing.

8. The valve assembly defined in claim 1, wherein the retaining means of said housing comprises a movable member extending from the housing and being foldable from a first open position to a second, folded position for secure abutment with said flexible member.

9. The valve assembly defined in claim 8, wherein said movable member comprises at least two foldable tabs.

10. The valve assembly defined in claim 1, wherein said debris collecting zone is further defined as being peripherally encircling said valve engaging inner wall portion.

11. The valve assembly defined in claim 1, wherein said housing is further defined as comprising c. a first upper section incorporating
  1. said retaining means, and
  2. an inner surface, and d. a second lower section incorporating
  1. said combustible fluid portal, and
  2. an outer wall in juxtaposed, facing, spaced relationship to said internal wall of said first section, forming the debris collection zone therebetween, and e. a portion of said second section being frictionally engaged with a portion of said first section, providing a leak-free interconnected two-piece housing.

12. The valve housing defined in claim 11, wherein said first section incorporates an internal wall, a portion of which is adapted for frictional engagement with said second secion, and said second section comprises an outer wall a portion of which is adapted for frictional engagement with the internal wall of said first section, whereby the non-engaged portion of the internal wall of the upper section and the outer wall of the second section cooperate to form particulate debris collection zones.

13. The valve housing defined in claim 12, wherein the frictional engagement portions of both the internal wall of the first section and the outer wall of the second section are formed about the lower edge of said walls, thereby providing an annular debris collection zone.

14. The valve housing defined in claim 13, wherein said second section is further defined as comprising an internal wall defining the wall along which the valve stem is slidingly engaged and said annular debris collecting zone is formed peripherally encircling said valve engaging inner wall of said second section.

15. The valve assembly defined in claim 11, wherein said first section is manufactured by die-casting, and said second section is manufactured by machining.

16. The valve assembly defined in claim 15, wherein said second section is manufactured from one selected from the group consisting of brass and aluminum.

17. The valve assembly defined in claim 11, wherein said second section is further defined as comprising a ledge portion cooperating with said radially extending shelf portion of said valve stem defining therewith an annular fluid collection zone.

18. The valve assembly defined in claim 1, wherein said housing is further defined as comprising:

c. a sealing system mounted about the outer peripheral surface of said housing and incorporating
  1. position retaining means formed about the outer peripheral surface of said housing, and
  2. a flexible, compressible sealing member mounted to and securely retained by said positioned retaining means.

19. The valve assembly defined in claim 18, wherein said flexible, compressible member is further defined as comprising an overall rectangular cross-sectional shape of uniform composition throughout its length.

20. The valve assembly defined in claim 19, wherein said flexible member is further defined as comprising flexible tubing and said position retaining means is further defined as comprising at least one annular ring formed about the outer surface of said housing for securely positioning and maintaining said compressible tubing in its sealing position without fear of movement or dislodgement.

21. The valve assembly defined in claim 1, wherein said valve stem is further defined as comprising:

d. a combustible fluid flow controlling channel formed along the outer surface thereof.

22. The valve assembly defined in claim 21, wherein the flow controlling channel of said valve stem cooperates with the retaining means of said housing to form a flow path at one position while preventing fluid flow at other positions.

23. The valve assembly defined in claim 21, wherein said valve stem further comprises position maintaining means formed in its exposed end for holding the valve stem in a desired orientation.

24. A valve assembly mounted within a gas lighter for controlling the flow of the combustible fluid comprising:

A. a housing readily engaged in a substantially sealed configuration with said gas lighter and incorporating,
   a. a combustible fluid flow portal at one end thereof positioned for receiving and passaging said combustible fluid therethrough,
   b. an inner wall portion which is slidingly engaged with a valve stem, and
   c. a concave debris collecting zone
      1. formed in the housing and
      2. having an entrance located between the retaining means and the slidingly engaged portion of the inner wall of the housing, providing a particulate debris collecting and storing zone;

B. sealing means mounted within said housing and positioned at the exit end of said fluid flow portal;

C. a valve stem slidably mounted within said housing and having
   a. a first end in abutting contact with said sealing means,
   b. a second end extending from said housing and responsive to lever means for raising said valve stem from a first closed position to a second open position,
   c. an outer wall, a portion of which is in sliding engagement with said inner wall portion of the housing, forming a sliding zone therebetween, and
   d. a shoulder radially extending from the outer wall of said valve stem towards the peripherally encircling housing and spaced above the entrance of the collection zone, thereby providing a deflector for directing particulate debris into the collection zone and away from the sliding zone, preventing debris fouling of the sliding zone; and D. lever means engaged about the exposed end of said valve stem and positioned for raising and lowering said valve stem from the closed position to an open position, whereby said valve assembly is able to deflect and store all particulate debris entering the housing, while assuring continuous, free slidability of the valve stem.

25. The valve assembly defined in claim 24, wherein said valve stem is further defined as comprising a sealing means receiving zone at its first end, securely retaining said sealing means therein for firm, abutting, repeatable sealing contact with said exit end of said fluid flow portal.

26. The valve assembly defined in claim 24, wherein said housing is further defined as comprising c. a sealing system formed about the external peripheral surface of said housing for sealingly engaging said housing with said gas lighter, said system incorporating
   1. at least one position retaining ring formed about the external surface of said housing and
   2. a compressible sealing member having a generally rectangular cross-sectional shape one side of which is frictionally engaged and securely retained about said retaining ring with at least another surface in sealing abutting contact with the body of said gas lighter.

27. A valve assembly for controlling the flame-feeding flow of a combustible fluid comprising:

A. a housing incorporating
   a. a combustible fluid portal at one end thereof positioned for receiving and passing said combustible fluid therethrough, and
   b. a valve stem engaging ring positioned on the opposite end thereof and incorporating means forming a peripherally surrounding valve stem opening for substantial sealing sliding engagement and lateral secure holding of the stem; and B. a valve stem
   a. slidably mounted within said housing and extending therefrom,
   b. movable from a first closed position to a second open, fluid flow position,
   c. cooperating with the valve stem engaging ring of the housing to substantially sealingly close the entire valve stem opening of the valve engaging ring, thereby substantially eliminating leakage of the combustible fluid therebetween, and
   d. incorporating an elongated, flame feeding, combustible fluid flow controlling channel notched into a minor portion of the outer peripheral circumferential surface thereof providing a specific, controlled, fluid flow path from a position within said housing to a position outside of said housing, whereby the quantity of combustible fluid delivered to the flame is controllingly maintained along the fixed minor circumferential area defined by the channel only, and undesirable combustible fluid flow between the remaining circumferential area between valve stem and the valve engaging ring is substantially eliminated.

28. The valve assembly defined in claim 27, wherein said valve stem is further defined as comprising d. an enlarged combustible fluid flow controlling channel extending from the fluid delivering terminating end of the valve stem to a position above the valve stem engaging ring of said housing for stabilizing the flow path and any flame fueled thereby.

29. The valve assembly defined in claim 27, wherein said valve stem comprises a substantially solid homogeneous member throughout its entire length.

30. The valve assembly defined in claim 27, wherein said valve stem is further defined as comprising a substantially centrally located fluid flow passageway formed within the valve stem substantially along its central axis, extending from the base thereof partially through the body of the valve stem, and communicating with at least one additional portal extending from the outer wall of the valve stem to the central passageway.

31. The valve assembly defined in claim 27, wherein said valve stem further comprises position holding means for assuring and maintaining the desired orientation of said valve stem.

32. The valve assembly defined in claim 27, wherein said valve stem engaging ring of the housing comprises a diameter which forms a close fitting sliding engagement with said valve stem for establishing a fluid flow path between said ring and said flow channel only, while preventing fluid flow at any alternative location about the peripherally engaged area of said valve stem and said engaging ring.

33. The valve assembly defined in claim 32, wherein said engaging ring comprises an integrally formed portion of said housing.

34. A valve assembly as defined in claim 27, further defined as mounted within a gas lighter for controlling the flow of the combustible fluid said valve stem engaging ring further comprising:

retaining means formed on one end thereof for securely holding a flexible biasing member in position, and said valve stem further having e. a first end in abutting contact with sealing means, f. a second end extending from said housing and responsive to lever means for raising said valve stem from a first closed position to a second open position, and g. a shoulder radially extending from the outer peripheral surface of said valve stem; and and said valve assembly further comprises C. sealing means mounted within said housing and positioned at the exit end of said fluid flow portal;

D. a flexible member a. mounted under compression between said retaining means of said housing and said shoulder portion of said valve stem in direct contact with said retaining means, and E. lever means engaged about the exposed end of said valve stem and positioned for counteracting said biasing forces of said flexible member by raising said valve stem from the closed position to an open position in response to an external force, whereby said valve assembly is normally in a closed position maintained therein by said flexible member which provides for movement of said valve stem to the open position in response to the external force on the lever means, allowing the free flow of the combustible fluid through the channel for ignition and flame size maintenance, and for the resilient return of the valve stem to said closed position upon removal of said force from said lever means.

35. A valve assembly for controlling the flow of a combustible fluid comprising:

A. a housing incorporating a. a first upper section incorporating an internal surface, b. a second lower second section incorporating 1. a combustible fluid portal at one end thereof positioned for receiving and passing said combustible fluid therethrough, 2. an inner wall for sliding engagement with a valve stem, forming a sliding zone therewith, 3. an outer wall i. in juxtaposed, facing, spaced relationship to said internal surface of said first section, forming a debris collection zone therebetween, and ii. in juxtaposed spaced relationship to the slidingly engaged inner wall of the second section, and 4. an upper end defining both the upper terminating edge of the sliding zone and the entrance to the debris collection zone c. a portion of said second section being frictionally engaged with a portion of said first section providing a leak-free interconnected two-piece housing; and B. a valve stem a. slidably mounted within said housing and extending therefrom, and b. movable from a first closed position to a second open, fluid flow position.

36. A valve assembly as defined in claim 35, wherein said valve assembly is mounted within a gas lighter for controlling the flow of the combustible fluid, said valve assembly comprising further:

C. sealing means mounted within said housing and positioned at the exit end of said fluid flow portal;

D. a valve stem further defined as comprising a. a first end in abutting contact with said sealing means, and b. a second end extending from said housing and responsive to lever means for raising said valve stem from the first closed position to the second open position, and E. lever means engaged about the exposed end of said valve stem and positioned for raising and lowering said valve stem between the closed position and the open position, whereby said valve assembly is able to store all particulate debris without interfering with the operation of the valve stem.

37. The valve assembly defined in claim 36, wherein said valve stem is further defined as comprising a radially extending shoulder positioned above the debris collection zone for deflecting particulate matter into said collection zone.

* * * * *